US005237820A

United States Patent [19]

Kastl et al.

[11] Patent Number: 5,237,820

[45] Date of Patent: Aug. 24, 1993

[54] INTEGRAL COMBUSTOR COWL PLATE/FERRULE RETAINER

[75] Inventors: John A. Kastl; David W. Parry; Alfred A. Mancini, all of Cincinnati, Ohio

[73] Assignee: General Electric Company, Cincinnati, Ohio

[21] Appl. No.: 815,799

[22] Filed: Jan. 2, 1992

[51] Int. Cl.[5] ..... F02C 1/00

[52] U.S. Cl. ..... 60/752; 60/747

[58] Field of Search ..... 60/737, 746, 747, 748, 60/752, 756

[56] References Cited

U.S. PATENT DOCUMENTS 4,194,358 3/1980 Stenger ..... 60/747

*Primary Examiner*—Richard A. Bertsch
*Assistant Examiner*—W. J. Wicker
*Attorney, Agent, or Firm*—James P. Davidson; Jerome C. Squillaro

[57] ABSTRACT

A combustor dome assembly is provided with a single continuous annular dome plate having at least one circumferential row of spaced openings therethrough, a swirl cup assembly attached to each of the dome plate openings, and inner and outer cowls connected to the radially inner and outer ends of the dome plate. A ferrule located immediately upstream of the swirl cup assembly acts as an interface between a fuel nozzle and the swirl cup assembly. An integral cowl plate/ferrule retainer is located immediately upstream of and connected to the swirl cup assembly, where the ferrule retainer portion retains the ferrule while allowing it to float radially therewithin and the cowl plate portion includes flanges which extend beyond the outer diameter of the swirl cup to provide blockage in addition to that provided by the inner and outer cowls.

17 Claims, 6 Drawing Sheets

INTEGRAL COMBUSTOR COWL PLATE/FERRULE RETAINER

The Government has rights in this invention pursuant to Contract No. F33657-83-C-0281 awarded by the Department of Air Force.

BACKGROUND OF THE INVENTION

1. Field of the Invention

The present invention relates to a combustor dome assembly for a gas turbine engine, and, more particularly, to an integral cowl plate/ferrule retainer for such combustor dome.

2. Description of Related Art

One of the critical parameters in combustor design is regulating the amount of air flow entering the dome assembly. This involves matching the "capture area," or area across the entrance of the combustor dome which is open to flow, to the diffuser opening (generally a ratio of approximately 3:1). The capture area is sized through the implementation of certain blockage elements such as cowls. If the capture area is not properly sized, it may cause spillage or regurgitation of air away from the dome (capture area too large) or reduce efficiency from the lack of air (capture area too small).

Current gas turbine engine combustors have generally been of a single annular design, whereby they contain one circumferential row of air swirlers and fuel nozzles. Annular inner and outer cowls are provided to define the inlet area to the combustor dome for the flow of air from the engine compressor. Accordingly, the inner and outer cowls provide the required capture area for high pressure recovery into the dome. In order to maintain an appropriate interface between the fuel nozzle and the swirl cup, a floating ferrule is provided and retained in the swirl cup casting by a sheet metal retainer.

More recently, dual annular combustors containing two rows of circumferential air swirlers and fuel nozzles have been developed. Such designs provide similar combustion performance to single annular combustors in essentially half the length thereof. However, the dual annular combustor requires less capture area (or more dome blockage) than two cowls can provide because of the increased dome height. Otherwise, spillage of the air from the dome region into the inner or outer passages of the combustor occurs, resulting in significant total pressure losses. Therefore, a total of four cowls are normally used in dual annular designs to provide the required capture area/blockage for each of the domes. This translates into inner and outer cowls being provided for each dome (four cowl design). In this design, air not captured by the two pairs of cowls is directed into a centerbody or the outer or inner passages. Existing dual annular designs, such as that disclosed in a development report to NASA for the Energy Efficient Engine ($E^3$), consist of separate inner and outer domes separated by a centerbody and bolted to two sets of inner and outer cowls. In this design, stamped sheet metal ferrule retainers are utilized.

It has been found that if a single continuous dome plate could be utilized, the centerbodies of prior art dual annular combustors could be eliminated, resulting in the advantages of reduced cost and weight, reduced cooling flow, and enhanced cross-fire between the domes. When the four-cowl configuration discussed above has been implemented in this design, however, attachment of the two center (or mid-dome) cowls has been extremely difficult. Moreover, the four-cowl design has no pressure communication between the domes and is therefore more sensitive to exit velocity profile fluctuations out of the diffuser.

Accordingly, a primary objective of the present invention is to provide a dual annular combustor having a single continuous dome plate with adequate dome blockage and pressure recovery.

Another objective of the present invention is to provide a dual annular combustor dome assembly having a single continuous dome plate with a two-cowl design.

Yet another objective of the present invention is to reduce the amount of weight of the combustor dome structure.

These objectives and other features of the present invention will become more readily apparent upon reference to the following description when taken in conjunction with the following drawing.

SUMMARY OF THE INVENTION

In accordance with one aspect of the invention, a combustor dome assembly is provided with a single continuous annular dome plate having at least one circumferential row of spaced openings therethrough, a swirl cup assembly attached to each of the dome plate openings, and inner and outer cowls connected to the radially inner and outer ends of the dome plate. A ferrule located immediately upstream of the swirl cup assembly acts as an interface between a fuel nozzle and the swirl cup assembly. An integral cowl plate/ferrule retainer is located immediately upstream of and connected to the swirl cup assembly, where the ferrule retainer portion retains the ferrule while allowing it to float radially therewithin and the cowl plate portion includes flanges which extend beyond the outer diameter of the swirl cup to provide blockage in addition to that provided by the inner and outer cowls.

BRIEF DESCRIPTION OF THE DRAWING

While the specification concludes with claims particularly pointing out and distinctly claiming the present invention, it is believed that the same would be better understood from the following description taken in conjunction with the accompanying drawing in which:

DETAILED DESCRIPTION OF THE INVENTION

Figure 1:
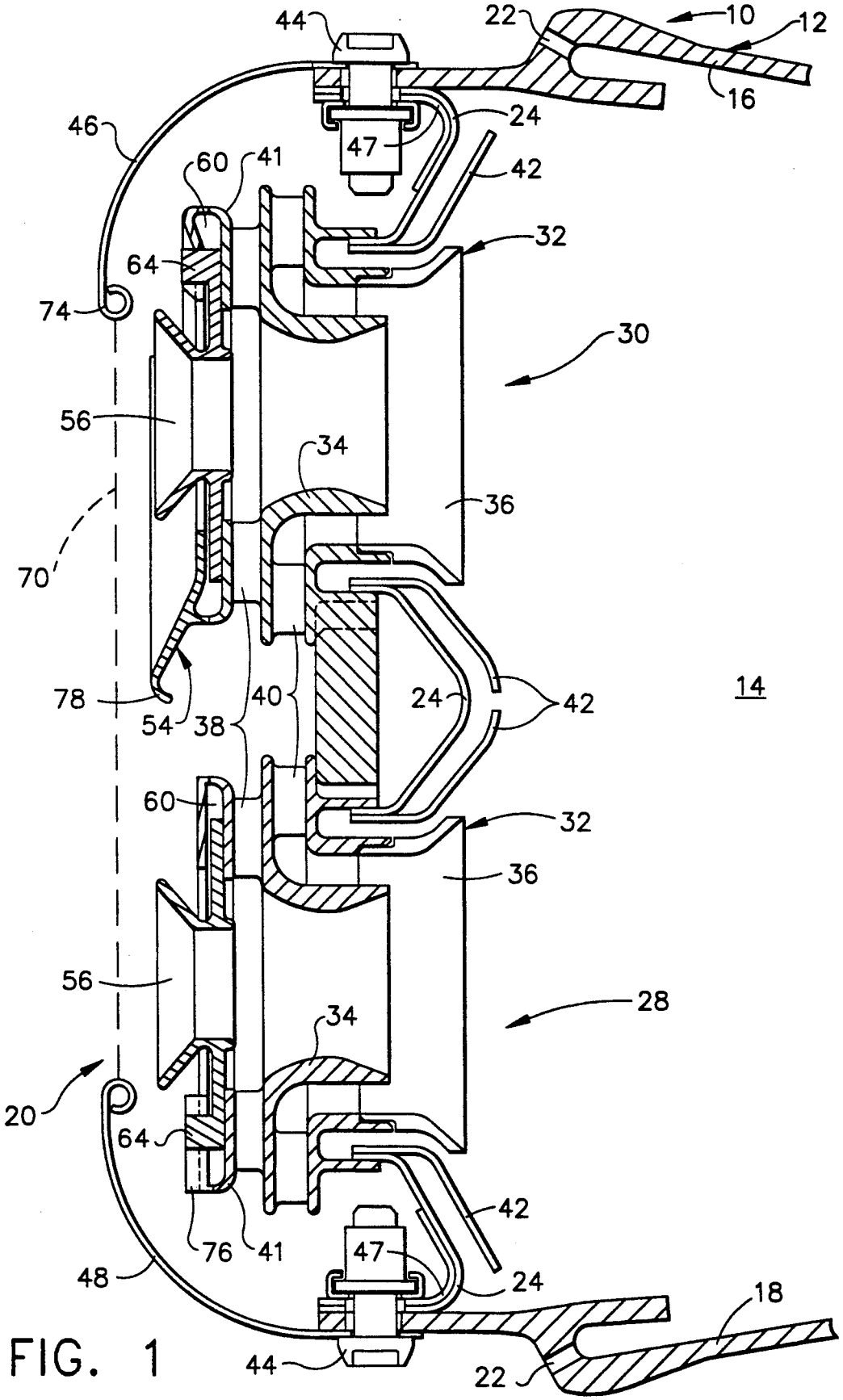
FIG. 1 is a longitudinal cross-sectional view of the combustor dome assembly of the present invention.

Referring now to the drawings in detail, wherein identical numerals indicate the same elements throughout the Figures, FIG. 1 is a partial, longitudinal cross-section view of a continuous-burning combustion apparatus 10 of the type suitable for use in a gas turbine engine and comprising a hollow body 12 defining a combustion chamber 14 therein. Hollow body 12 is generally annular in form and is comprised of an outer liner 16 and an inner liner 18. At the upstream end of hollow body 12 is an annular opening 20 for the introduction of air and fuel in a preferred manner as will be described hereinafter.

The hollow body 12 may be enclosed by a suitable shell (not shown) which, together with liners 16 and 18, defines outer and inner passages (not shown), respectively, which are adapted to deliver in a downstream flow the pressurized air from a suitable source such as a compressor and a diffuser. The compressed air from a diffuser passes principally into annular opening 20 to support combustion and partially to the outer and inner passages where it is used to cool liners 16 and 18 by way of a plurality of apertures 22 and to cool the turbomachinery further downstream.

Disposed between and interconnecting outer and inner liners 16 and 18 near their upstream ends preferably is a single continuous annular dome plate 24 for the reasons stated hereinabove. Dome plate 24 preferably has two circumferential rows of spaced openings 26 therethrough to form inner and outer domes 28 and 30, respectively. Dome plate 24 is therefore arranged in a so-called double annular configuration wherein two separate, radially spaced, annular combustors act somewhat independently as separate combustors during various staging operations. Disposed within inner and outer domes 28 and 30 is a plurality of circumferentially spaced swirl cup assemblies 32, which are castings that include a venturi 34, a sleeve 36, a primary swirler 38, a secondary swirler 40, a backplate 41 and a splashplate 42. Preferably, the swirl cup assembly is brazed into inner dome 28 and outer dome 30. This type of swirl cup assembly is well known in the art and does not comprise a part of the present invention.

Figure 3:
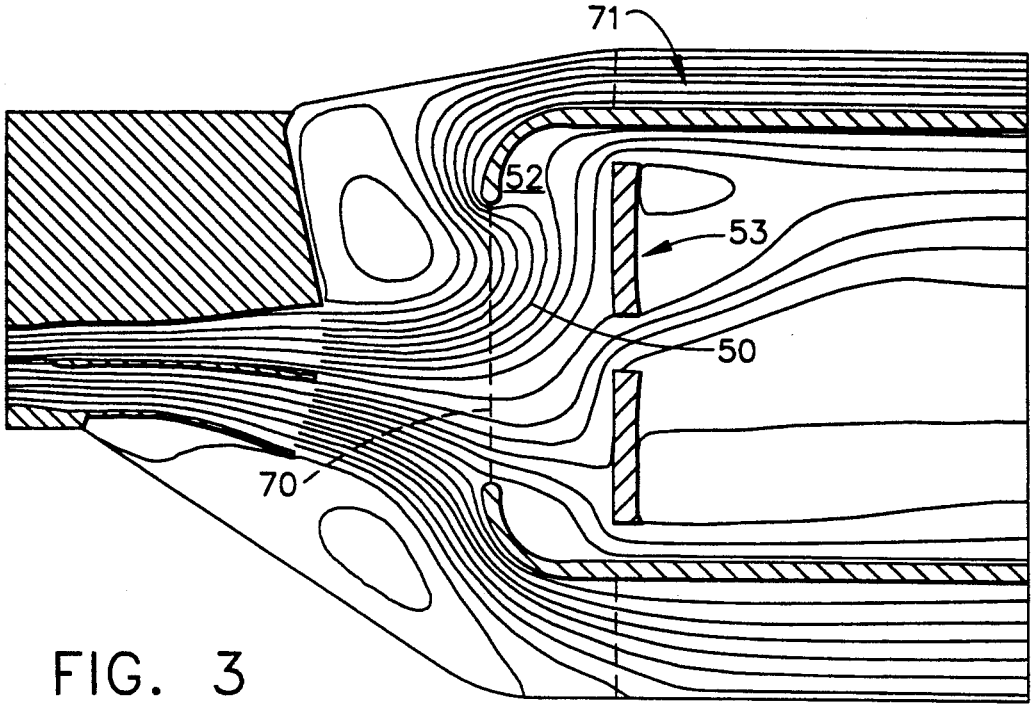
FIG. 3 (PRIOR ART)
FIG. 3 is a diagrammatic view of the airstream entering a dual annular combustor dome having a conventional two-cowl design.

Dome plate 24 is connected to inner and outer liners 18 and 16 by means of a bolt assembly 44 or similar means. A dome band doubler 47 is preferably provided at the liner-dome plate connections to enhance the structural stability of dome plate 24. Outer and inner cowls 46 and 48 are attached to dome plate 24 through bolting assemblies 44 as well. Inner and outer cowls 48 and 46 are provided in order to control the amount of air flow from the diffuser into the combustor dome assembly. The amount of area through which air flow is allowed to enter the dome assembly is known as the "capture area" as defined by the amount of dome blockage. It has been found that a normal two-cowl configuration does not provide the necessary dome blockage for the dome assembly of a dual annular combustor. This is exemplified by the low number of streamlines 50 entering outer cowl opening 52 through outer dome 53 as seen in FIG. 3. In addition, the use of a four-cowl configuration with a single continuous dome plate, where cowls are also placed in a mid-dome location, does not provide good pressure recoveries into outer dome 30 since there is no pressure communication between the inner and outer domes.

Figure 5:
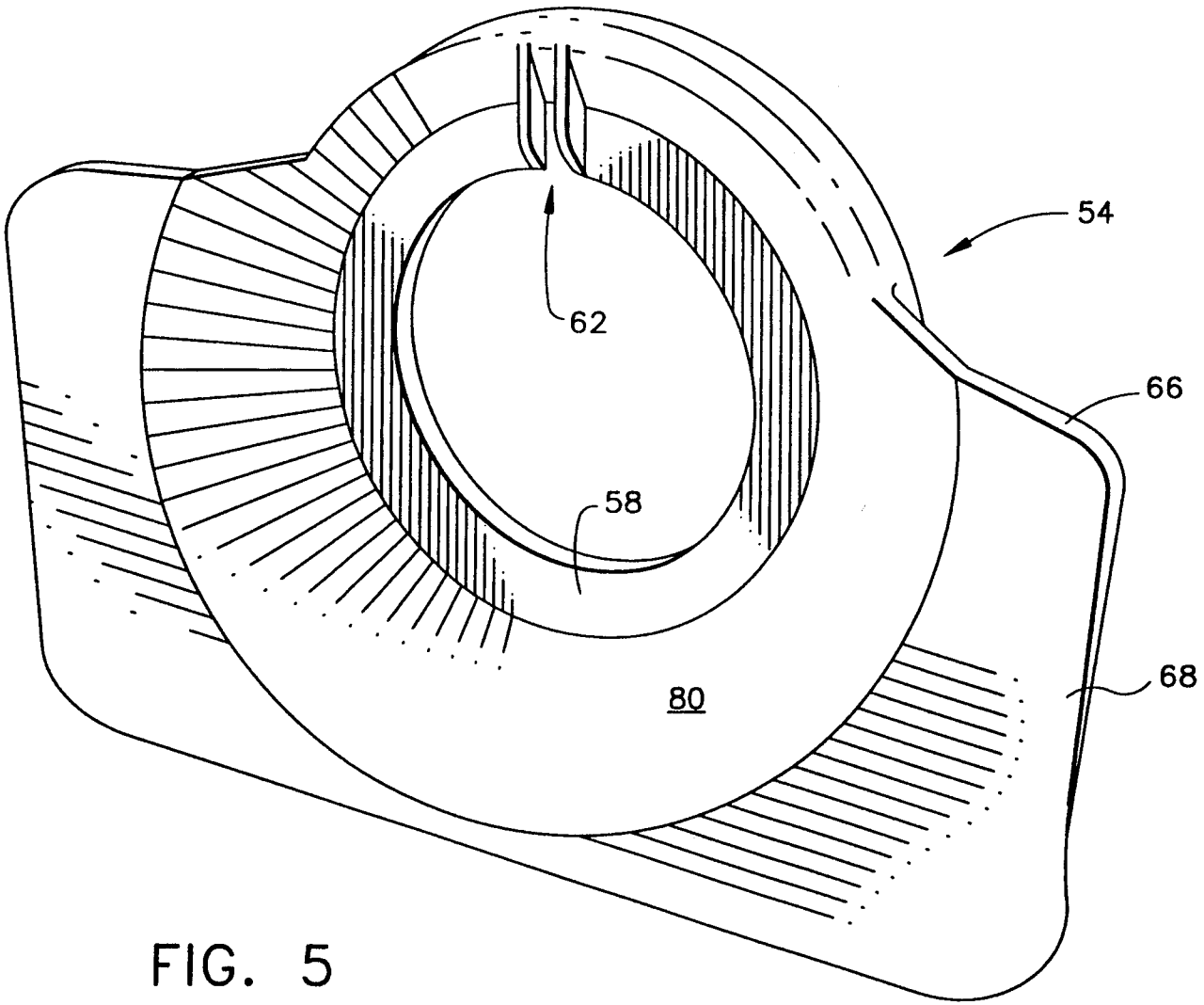
FIG. 5 is a perspective view of the integral cowl plate/ferrule retainer of the present invention.
Figure 6:
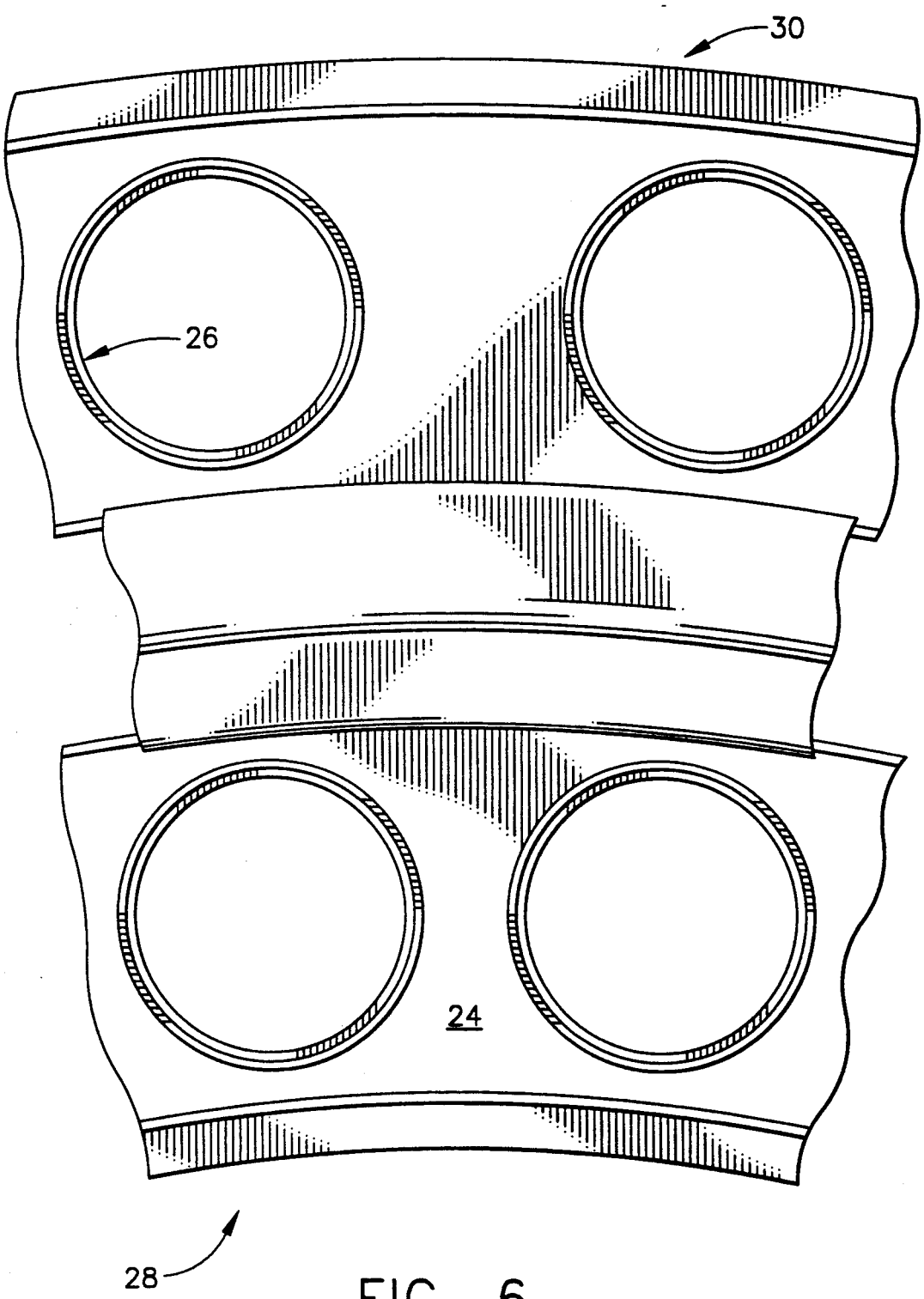
FIG. 6 is an aft looking forward view of the combustor dome assembly of FIG. 1 with the cowls and swirler cup assembly being omitted for clarity.

Accordingly, the present invention provides an integral cowl plate/ferrule retainer 54, as best seen in FIG. 5. Integral cowl plate/ferrule retainer 54 optimizes dome blockage when used in conjunction with inner and outer cowls 48 and 46, as well as increases pressure recoveries in outer dome 30. By using single continuous sheet metal dome plate 24 and replacing the two center cowls of the prior art with integral cowl plate/ferrule retainer 54, significant cost and weight savings are realized. A further benefit of the integral cowl plate/ferrule retainer 54 is that cowl plate portion 66 is stiffer than the mid-dome cowls of the prior art and therefore is more resistant to high cycle fatigue.

Figure 2:
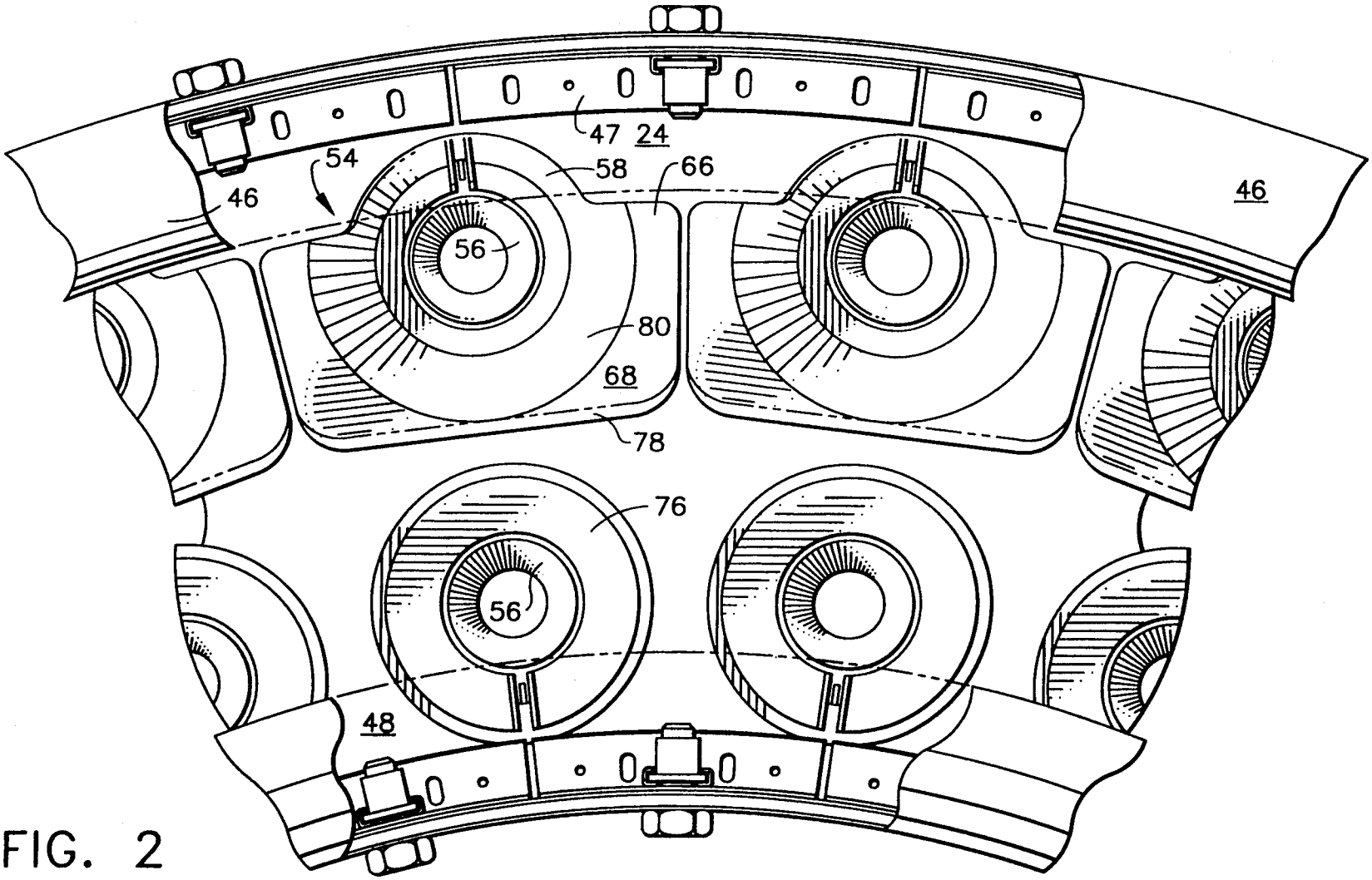
FIG. 2 is a partial, axial aft view of the combustor dome assembly of FIG. 1 with the cowls omitted.
Figure 2A:
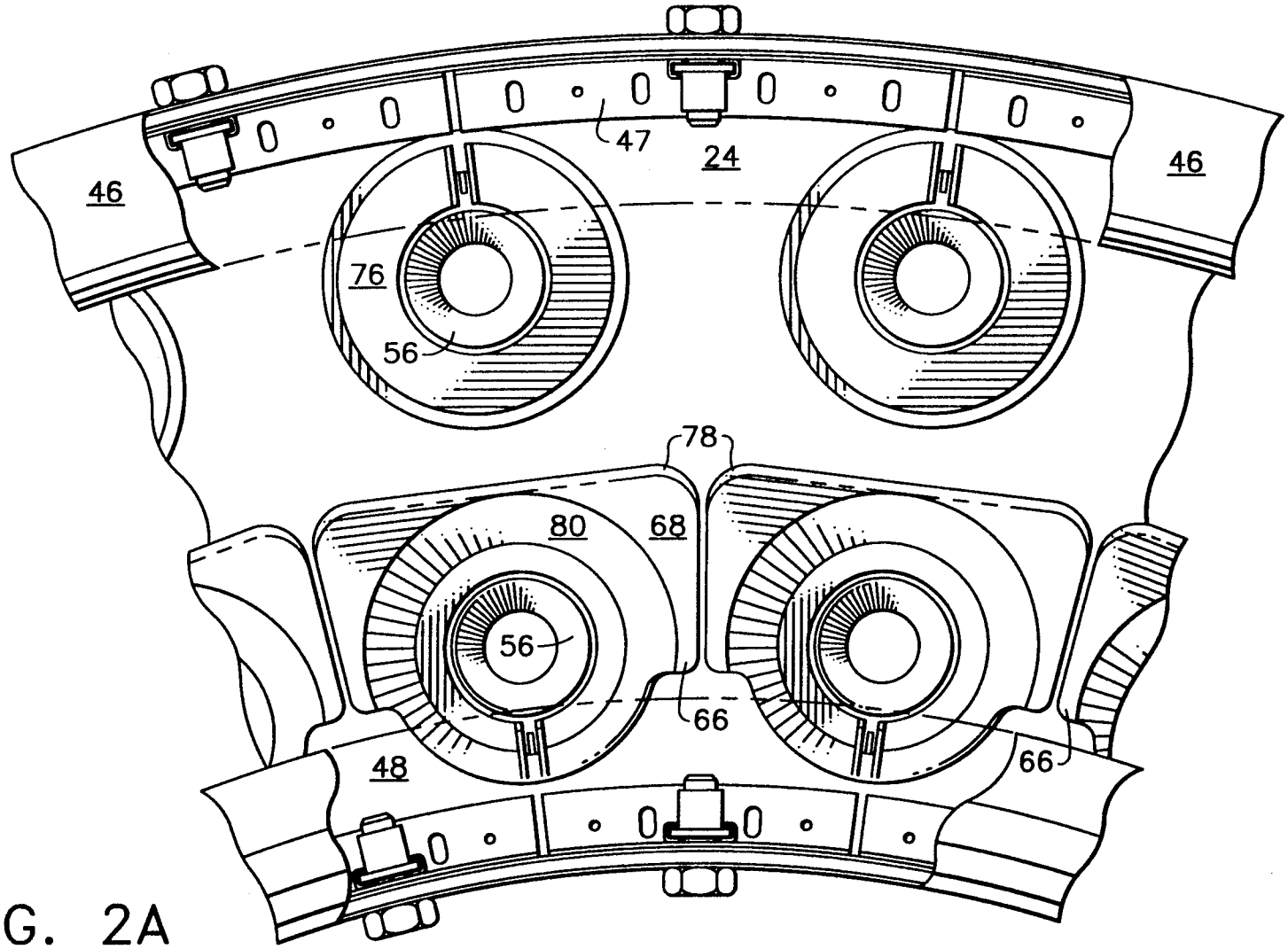
FIG. 2A is a partial axial aft view of an alternative combustor dome assembly, wherein the integral cowl plate/ferrule retainer is positioned on only the inner annular domes, the cowls being omitted for clarity.

In particular, integral cowl plate/ferrule retainer 54 is attached to backplate 41 of swirl cup assembly 32 where it retains a fuel nozzle ferrule 56. Ferrule 56 requires the ability to move or "float" within ferrule retainer portion 58, so ferrule retainer portion 58 of integral cowl plate/ferrule retainer 54 is sized to retain ferrule 56 and include a float gap 60. As depicted in FIGS. 1, 2, and 5, ferrule retainer portion 58 includes a slot 62 into which an anti-rotation tab 64 of ferrule 56 is held, thereby preventing spinning of ferrule 56.

Figure 4:
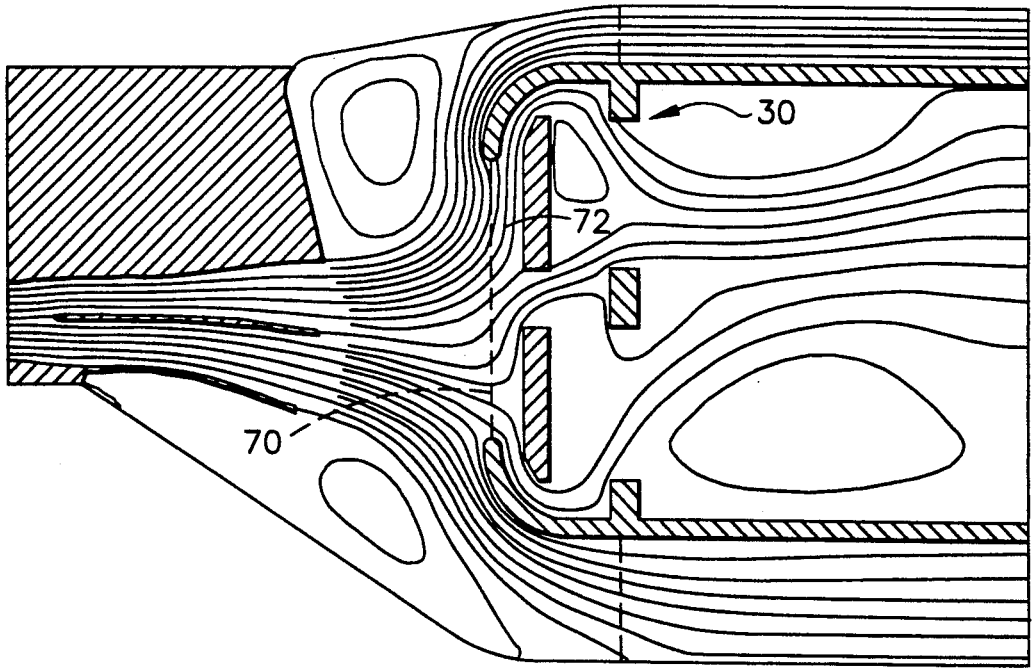
FIG. 4 is a diagrammatic view of the airstream entering a dual annular combustor dome assembly having a two-cowl design employing the present invention.

Integral cowl plate/ferrule retainer 54 includes a cowl plate portion 66 which includes flanges 68 that extend beyond the outer diameter of swirl cup 32 to provide additional blockage area. The additional blockage turns part of the airflow from the diffuser radially outward to prevent inner and outer cowls 48 and 46 from capturing too much flow (which would result in spillage into the outer passage). This type of spillage is indicated in FIG. 3, where streamlines 50 twice cross a cowl capture plane 70 defined between inner and outer cowls 48 and 46, and then enters outer passage 71. This spillage is remedied by integral cowl plate/ferrule retainer 54 of the present invention, as depicted by streamlines 72 of FIG. 4, where streamlines 72 cross cowl capture plane 70 only once before entering outer dome 30. Integral cowl plate/ferrule retainer 54 simultaneously decelerates flow and pressurizes outer dome 30 by forcing flow under outer cowl 46, which further has the effect of equalizing the radial pressure profile from the diffuser which is inward skewed. In order to enhance this direction of flow, flanges 68 of cowl plate portion 66 are sized so as to remain radially inside of a lip 74 of outer cowl 46.

While integral cowl plate/ferrule retainer 54 may be utilized with both inner dome 28 and outer dome 30, it has been found that the required blockage area for the present combustor dome assembly can be accomplished with integral cowl plate/ferrule retainer 54 on only one dome. Since in the present design the flow needs to be turned more in outer dome 30 than inner dome 28, integral cowl plate/ferrule retainer 54 is shown in FIGS. 1 and 2 as being located on outer dome 30, with inner dome ferrule retainers 76 being of a conventional sheet metal design.

In order to better understand whether integral cowl plate/ferrule retainer 54 should be utilized on either outer dome 30 or inner dome 28, it is important to note that the direction of the diffuser must be taken into account, as well as any radial skewing of the exit velocity profile from the diffuser. Because it has been found that the diffuser will normally be pointed more toward inner dome 28 in order to provide greater pressure recovery to the inner passage, and optimize the feed pressure ratio to the turbine, integral cowl plate/ferrule retainer 54 is depicted in FIGS. 1–3 as being utilized with outer dome 30.

In order to provide additional stiffness and a smooth aerodynamic flow path, an inner edge 78 of cowl plate portion 66 is rolled over as best seen in FIG. 1. It will also be noted that integral cowl plate/ferrule retainer 54 includes an annular conical section 80 Which acts as a transition are from ferrule retainer portion 58 to cowl plate portion 66 in order to provide additional stiffness. Integral cowl plate/ferrule retainer 54 is not only sized to remain radially inside of outer cowl 46, but is located axially aft of cowl capture plane 70 in order that outer dome 30 may be pressurized with flow turned by cowl plate portion 66 and captured under outer cowl 46 to increase pressure recoveries in outer dome 30. It will also be understood that integral cowl plate/ferrule retainer 54 may be a single annular casting which is stiffened to eliminate high cycle fatigue and wear problems which occur in existing sheet metal cowls.

Having shown and described the preferred embodiment of the present invention, further adaptations of the combustor dome assembly for preventing flow spillage and low pressure recoveries can be accomplished by appropriate modifications by one of ordinary skill in the art without departing from the scope of the invention.

We claim:

1. A combustor dome assembly, comprising:

(a) an annular dome plate with two circumferential rows of spaced openings therethrough to form a double annular combustor having inner and outer domes;

(b) a swirl cup assembly attached to each of said dome plate openings, said swirl cup assembly including a venturi, a sleeve, a primary swirler, a backplate, a secondary swirler and a splashplate;

(c) an inner cowl and an outer cowl connected to the radially inner and outer ends of said dome plate; and (d) an integral cowl plate/ferrule retainer attached to said backplate for blocking air low to said dome plate in addition to that provided by said inner and outer cowls, wherein said integral cowl plate/ferrule retainer is aft of a cowl plane defined between said inner and outer cowls and forward of said backplate.

2. The combustor dome assembly of claim 1, wherein only said outer annular domes include said integral cowl plate/ferrule retainer.

3. The combustor dome assembly of claim 1, wherein only said inner annular domes include said integral cowl plate/ferrule retainer.

4. The combustor of claim 1, wherein said dome plate is a single continuous annular piece.

5. The combustor dome assembly of claim 1, wherein said integral cowl plate/ferrule retainer includes a cowl plate portion having flanges which extend beyond the outer diameter of said swirl cup.

6. The combustor dome assembly of claim 5, wherein said flanges are substantially rectangular in shape.

7. The combustor dome assembly of claim 5, wherein said flanges remain radially inside of said outer cowl for said outer dome and radially outside of said inner cowl for said inner dome.

8. A combustor dome assembly, comprising:

(a) a single continuous annular dome plate having at least one circumferential row of spaced openings therethrough;

(b) a swirl cup assembly attached to each of said dome plate openings, said swirl cup assembly including a venturi, a sleeve, a primary swirler, a secondary swirler, a backplate, and a splashplate;

(c) an inner cowl and an outer cowl connected to the radially inner and outer ends of said dome plate;

(d) a ferrule located immediately upstream of said swirl cup assembly which acts as an interface between a fuel nozzle and said swirl cup assembly; and (e) an integral cowl plate/ferrule retainer immediately upstream of and connected to said backplate, wherein a ferrule retainer portion is sized to retain said ferrule while allowing said ferrule to float radially therewithin and a cowl plate portion includes flanges which extend beyond the outer diameter of said swirl cup assembly to provide blockage of incoming air in addition to blockage provided by said inner and outer cowls.

9. The combustor dome assembly of claim 8, wherein said integral cowl plate/ferrule retainer is a single annular piece.

10. The combustor dome assembly of claim 8, wherein said ferrule includes a tab which fits into a slot in said ferrule retainer portion to prevent rotation of said ferrule.

11. The combustor dome assembly of claim 8, wherein said integral cowl plate/ferrule retainer includes an annular conical section between said cowl plate portion and said ferrule retainer portion.

12. The combustor dome assembly of claim 11, wherein said dome plate has two circumferential rows of spaced openings therethrough to form a double annular combustor having inner and outer domes.

13. The combustor dome assembly of claim 12, wherein only said outer annular domes include said integral cowl plate/ferrule retainer.

14. The combustor dome assembly of claim 13, wherein said cowl plate flanges remain radially inside said outer cowl.

15. The combustor dome assembly of claim 13, wherein an inner edge of said cowl plate portion is rolled over to provide additional stiffness and a smooth aerodynamic flow path.

16. The combustor dome assembly of claim 13, wherein said integral cowl plate/ferrule retainer is located axially aft of a cowl capture plane extending radially between said inner and outer cowls, wherein said outer domes are pressurized with flow turned by said cowl plate portion and captured under said outer cowl, whereby pressure recoveries in said outer domes are increased.

17. A double annular combustor assembly, comprising:

(a) a single continuous annular dome plate having two circumferential rows of spaced openings therethrough to form inner and outer domes;

(b) a swirl cup assembly attached to each of said dome plate openings, said swirl cup assembly including a venturi, a sleeve, a primary swirler, a secondary swirler, a backplate, and a splashplate;

(c) an inner cowl and an outer cowl connected to the radially inner and outer ends of said dome plate;

(d) a ferrule located immediately upstream of said swirl cup assembly which acts as an interface between a fuel nozzle and said swirl cup assembly; and (e) an integral cowl plate/ferrule retainer immediately upstream of and connected to said backplate of said outer domes, wherein a ferrule retainer portion is sized to retain said ferrule while allowing said ferrule to float radially therewithin and a cowl plate portion includes flanges which extend beyond the outer diameter of said swirl cup assembly to provide blockage of incoming air in addition to blockage provided by said inner and outer cowls.

* * * * *